US006925974B2

(12) United States Patent
Yoon

(10) Patent No.: US 6,925,974 B2
(45) Date of Patent: Aug. 9, 2005

(54) WOBBLE PLATE ENGINE

(76) Inventor: Jeen Mok Yoon, Taehwa Apt. 1-101, 363 Galsan 2-dong, Bupyeong-gu, Incheon (KR), 403-709

( * ) Notice: Subject to any disclaimer, the term of this patent is extended or adjusted under 35 U.S.C. 154(b) by 182 days.

(21) Appl. No.: 10/470,273

(22) PCT Filed: Feb. 9, 2002

(86) PCT No.: PCT/KR02/00220

§ 371 (c)(1),
(2), (4) Date: Aug. 7, 2003

(87) PCT Pub. No.: WO02/064949

PCT Pub. Date: Aug. 22, 2002

(65) Prior Publication Data

US 2004/0060526 A1 Apr. 1, 2004

(30) Foreign Application Priority Data

Feb. 9, 2001 (KR) ..... 2001-6295
Jan. 24, 2002 (KR) ..... 2002-4180

(51) Int. Cl.[7] ..... F16H 23/00
(52) U.S. Cl. ..... 123/56.1; 123/56.3
(58) Field of Search ..... 123/56.1, 56.3

(56) References Cited

U.S. PATENT DOCUMENTS 2,155,455 A * 4/1939 Hans ..... 91/489
3,039,676 A * 6/1962 Mikina ..... 74/22 R
3,182,644 A * 5/1965 Dritina ..... 123/56.1
3,945,359 A * 3/1976 Asaga ..... 123/56.1
4,565,103 A * 1/1986 Brille ..... 74/60
4,622,927 A 11/1986 Wenker
6,003,480 A * 12/1999 Quayle et al. ..... 123/56.1
6,397,794 B1 * 6/2002 Sanderson et al. ..... 123/48 B
6,446,587 B1 * 9/2002 Sanderson et al. ..... 123/56.1

FOREIGN PATENT DOCUMENTS

EP 471451 A1 2/1992
JP 55-37541 A 3/1980

* cited by examiner

*Primary Examiner*—Henry C. Yuen
*Assistant Examiner*—Jason Benton
(74) *Attorney, Agent, or Firm*—Bacon & Thomas

(57) ABSTRACT

A wobble plate engine includes a cylinder block, a plurality of pistons, a drive shaft, a weight, an oscillating member, a plurality of rods connecting the pistons to the oscillating member, a pair of bevel gears and a plurality of thrust bearing assemblies wherein the plurality of thrust bearing assemblies are installed at the cylinder block and the oscillating member to support the straight shaft, the weight and the declined shaft and reduce a rotational velocity transferred therefrom.

5 Claims, 6 Drawing Sheets

WOBBLE PLATE ENGINE

FIELD OF THE INVENTION

The present invention relates to a wobble plate engine; and, more particularly, to a wobble plate engine having a simple single side support structure.

BACKGROUND OF THE INVENTION

Though a wobble plate engine has been known for about 70 years, it has not been widely accepted as an internal combustion engine. The use of the wobble plate engine has been limited to a hydraulic pump or devices driven by other engine. Various attempts have been made to improve or modify the design of the wobble plate engine in order to use the wobble plate engine as an internal combustion engine.

A conventional wobble plate engine 10, which is disclosed in an International Publication No. WO 97/19254, will now be explained with reference to FIG. 1.

The conventional wobble plate engine shown in FIG. 1 includes a wobble hub 29 formed as a part of a drive shaft 30. A wobble plate 31 is rotatably mounted on the wobble hub 29 by bearings 32. Conrods 33 connect a plurality of pistons 34 to the wobble plate 31. Each piston 34 reciprocates within one of a plurality of cylinders 36 formed in a pair of cylinder blocks 37. And both ends of the drive shaft 30 are supported in the cylinder block 37 by thrust bearings 38.

However, since the conventional wobble plate engine configured as described above has a both sides support structure in which the two pairing cylinder blocks 37 are placed opposite to each other with the wobble plate 31 intervened therebetween and both ends of the drive shaft 30 are supported at the two opposite cylinder blocks 37 via the trusting bearings 38, the structure is very complicated. In addition, it is very difficult to miniaturize the conventional wobble plate engine because of a large volume thereof.

SUMMARY OF THE INVENTION

It is, therefore, an object of the present invention to provide a wobble plate engine having a single side support structure, which allows the engine to be scaled down in size and weight.

In accordance with the present invention, there is provided a wobble plate engine including a cylinder block in which a plurality of cylinders are circularly disposed; a plurality of pistons, each being installed in one of the cylinder to reciprocate therein; a drive shaft having a straight shaft and a declined shaft, the straight shaft being rotatably installed at a center portion of the cylinder block and the declined shaft being extended from an end portion of the straight shaft; a weight formed at a joint portion of the straight shaft and the declined shaft in such a manner as to be extended opposite to the declined shaft; an oscillating member supported at the declined shaft of the drive shaft; a plurality of rods connecting the pistons to the oscillating member; a pair of bevel gears, each bevel gear facing the other, and respectively formed at the oscillating member and the cylinder block to prevent the oscillating member from rotating; and a plurality of thrust bearing assemblies installed at the cylinder block and the oscillating member to support the straight shaft, the weight and the declined shaft and reduce a rotational velocity transferred therefrom.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

The preferred embodiments of the present invention will now be described in detail with reference to the drawings.

Figure 1:
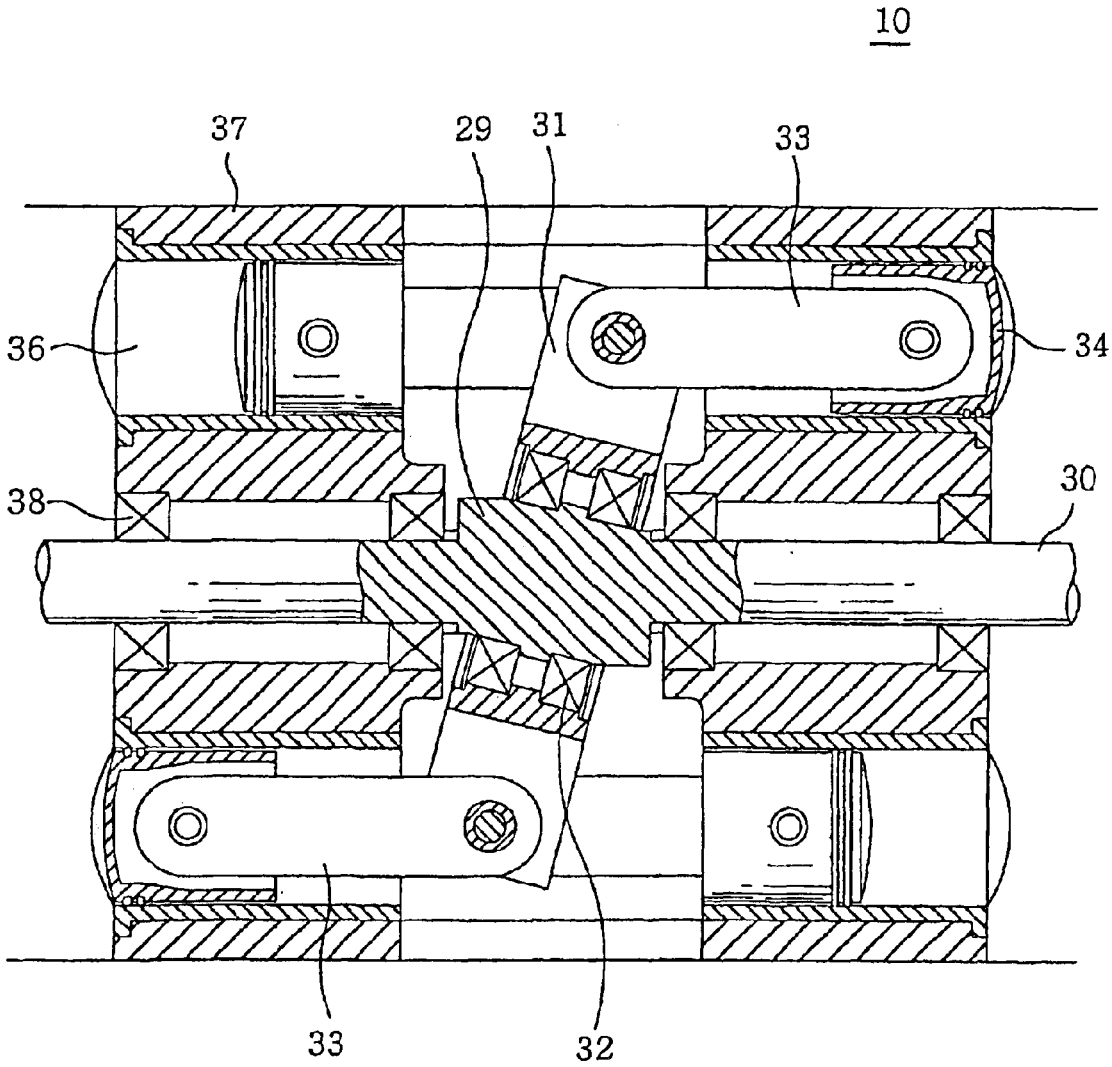
FIG. 1 is a cross-sectional view of a conventional wobble plate engine.
Figure 2:
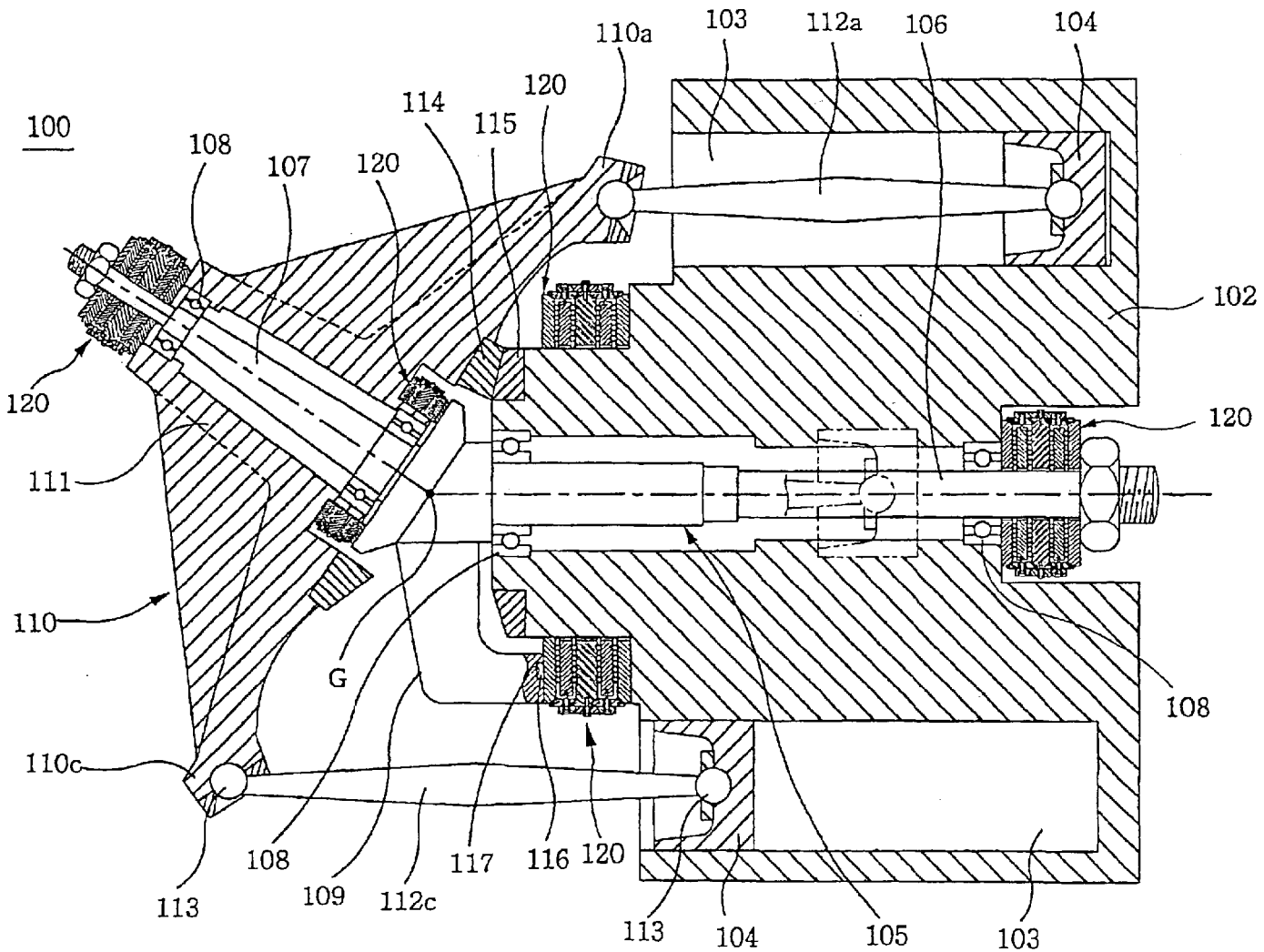
FIG. 2 provides a cross-sectional view of a wobble plate engine in accordance with the present invention.
Figure 3:
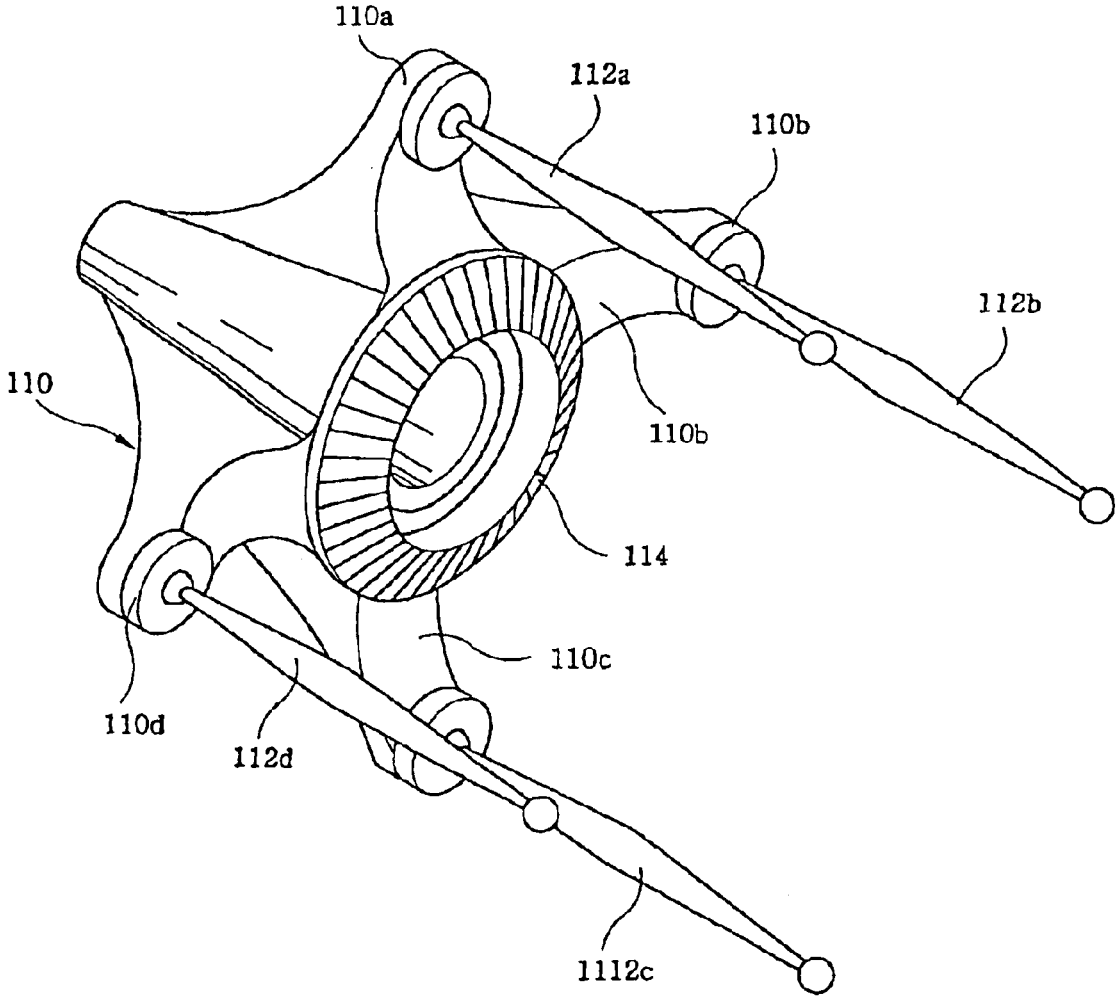
FIG. 3 depicts a perspective view of an oscillating member shown in FIG. 2.
Figure 4:
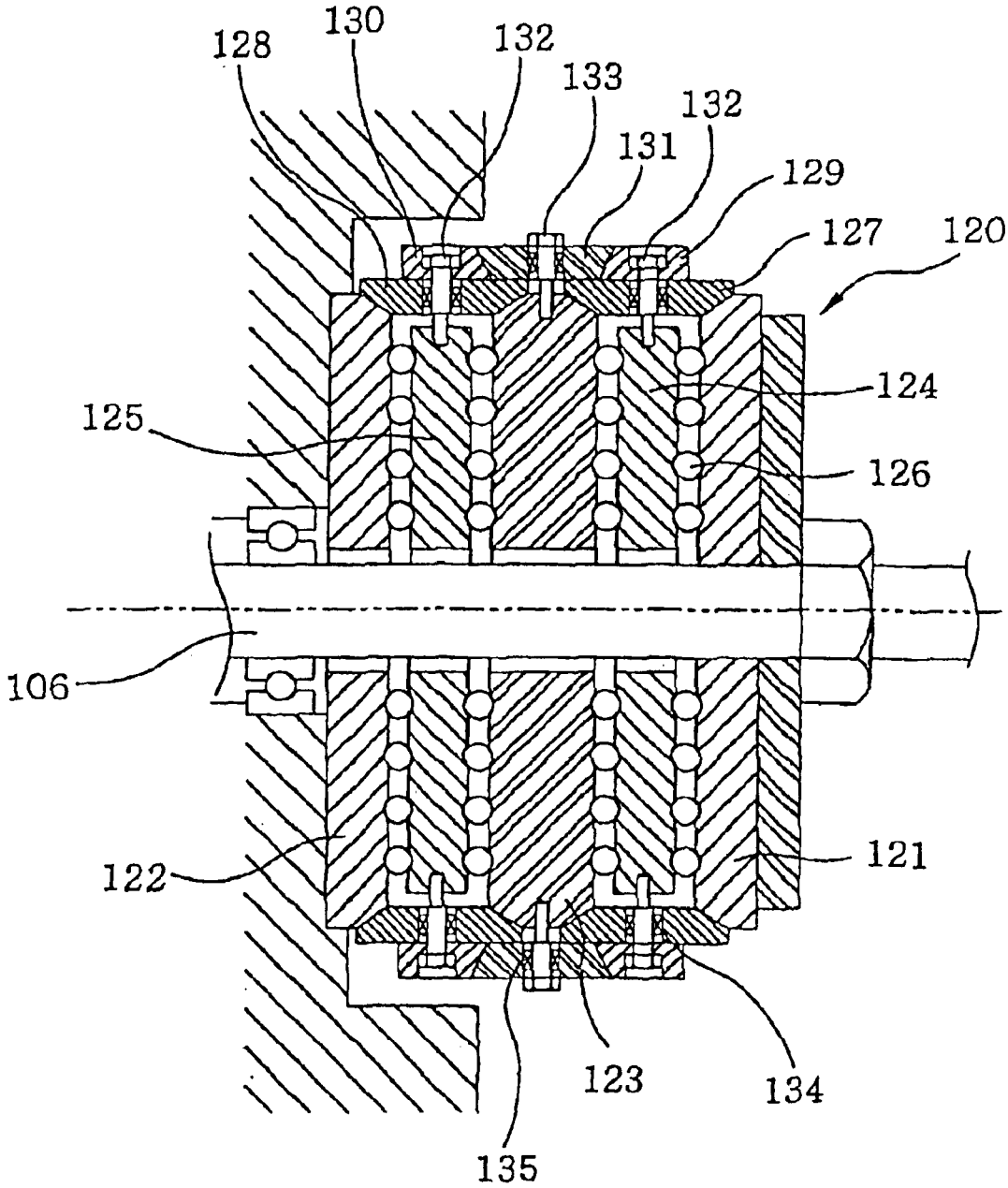
FIG. 4 sets forth an enlarged view of a thrust bearing assembly shown in FIG. 2.
Figure 5:
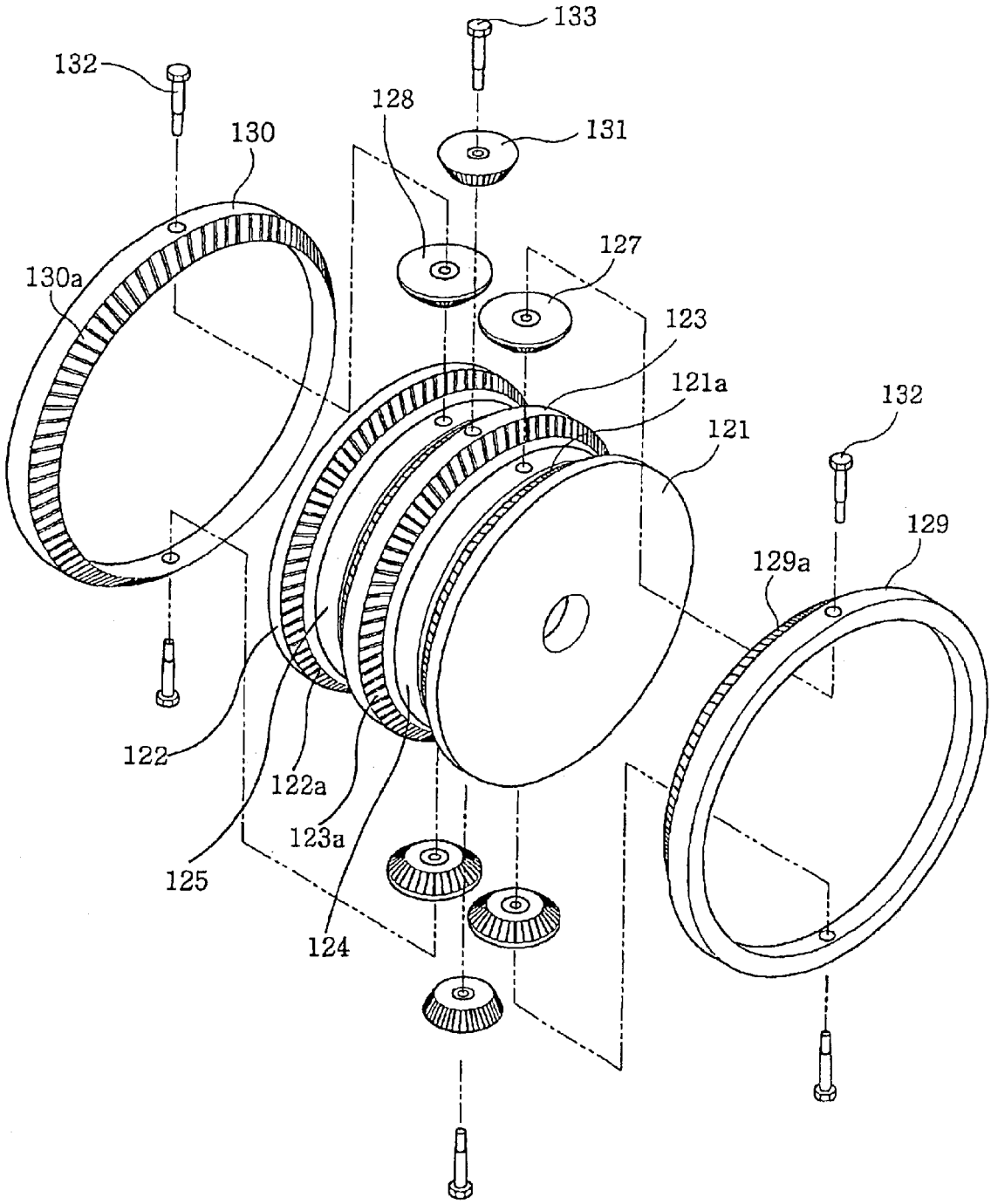
FIG. 5 offers an exploded perspective view of the thrust bearing assembly shown in FIG. 2.

Referring to FIG. 2, there is provided a cross-sectional view of a wobble plate engine 100 in accordance with the present invention. FIG. 3 provides a cross-sectional view of an oscillating member 110 shown in FIG. 2. FIGS. 4 and 5 respectively offer an enlarged view and an exploded perspective view of a thrust bearing assembly 120 shown in FIG. 2.

As shown in FIG. 2, the wobble plate engine 100 includes a cylinder block 102 in which four cylinders 103 (though only two cylinders are shown in FIG. 2) are circularly disposed around a straight shaft 106 separated (?: "separated" inserted) with 90° intervals. A piston 104 is installed in each of the four cylinders 103 in such a manner that it can reciprocate therein.

The wobble plate engine 100 includes a drive shaft 105 having the straight shaft 106 and a declined shaft 107. The straight shaft 106 is inserted into a center portion of the cylinder block 102 and is supported at one end by a ball bearing 108 and at the other end by a thrust bearing assembly 120. The declined shaft 107 is connected to the one end of the straight shaft 106, i.e., the one supported by the ball bearing 108.

A weight 109 is attached to a joint portion of the straight shaft 106 and the declined shaft 107 extended opposite to the declined shaft 107. One end of the weight 109 is supported by the thrust bearing assembly 120 which is prepared at a front portion of the cylinder block 102. The weight 109 is preferably of a fan shape.

A boss 111 of an oscillating member 110 is supported by the declined shaft 107 through the ball bearing 108 and the thrust bearing assembly 120. As shown in FIG. 3, the oscillating member 110 has four arms 110*a* to 110*d* that are located around the boss 111 separated with a 90° intervals.

One end of each of rods 112*a* to 112*d* is connected to an end of corresponding one of the arms 110*a* to 110*d* through a ball joint 113. The other end of each of rods 112*a* to 112*d* is rotatably and tiltingly connected via the ball joint 113 to a corresponding one of the pistons 104 respectively formed at the four cylinders 103 in the cylinder block 102.

Where the oscillating member 110 and the cylinder block 102 are brought into contact with each other, two bevel gears 114, 115 are prepared at the oscillating member 110 and the cylinder block 102, respectively, to be partially meshing with each other, preventing the oscillating member 110 from rotating.

In contact surface of the weight 109 and the thrust bearing assembly 120 formed at the front portion of the cylinder block 102, a protruding part 116 and a groove 117 are formed in the thrust bearing assembly 120 and the weight 109, respectively, to be engaged with each other. As shown in FIGS. 4 and 5, the thrust bearing assembly 120 includes a first, a second and a third circular plate 121 to 123. The first circular plate 121 has a bevel gear 121*a* formed at one side thereof and the second circular plate 122 has a bevel gear 122*a* formed at one side thereof. The third circular plate 123 disposed between the first and the second circular plate 121 and 122 has bevel gears 123*a* formed at both sides thereof.

Disposed between the first and the third circular plate 121, 123 and between the third and the second circular plate 123, 122 are disposed a forth and a fifth circular plate 124, 125, respectively. Installed between each of the first to fifth circular plates 121 to 125 are a multiplicity of balls 126 arranged in a plurality of rows.

A plurality of first bevel pinion gears 127 mesh with the bevel gear 121*a* of the first circular plate 121 and the bevel gear 123*a* of the third circular plate 123. A multiplicity of second bevel pinion gears 128 mesh with the bevel gear 123*a* of the third circular plate 123 and the bevel gear 122*a* of the second circular plate 122.

A first and a second bevel ring gear 129 and 130 are installed at the first and the second bevel pinion gears 127, 128, respectively, in a manner as to cover the first and the second bevel pinion gear 127, 128. Formed at one side of the first and the second bevel ring gear 129, 130 are bevel gears 129*a*, 130*a*. A plurality of third bevel pinion gears 131 mesh with the bevel gears 129*a*, 130*a* formed at the bevel ring gears 129, 130.

The first and the second bevel ring gear 129, 130, the first and the second bevel pinion gear 127, 128, and the fourth and the fifth circular plate 124 and 125 are all connected in one body by a plurality of first connecting parts 132. The individual connecting parts 132 are inserted into respective center portions of the first and the second bevel pinion gear 127, 128 along with a bearing 134 to support the first and the second bevel pinion gear 127, 128 rotatably.

The third bevel pinion gear 131 and the third circular plate 123 are connected in one body by a plurality of second connecting parts 133. The individual second connecting parts 133 are inserted into a center portion of the third bevel pinion gear 131 along with a bearing 135 to support the third bevel pinion gear 131 rotatably.

Figure 6:
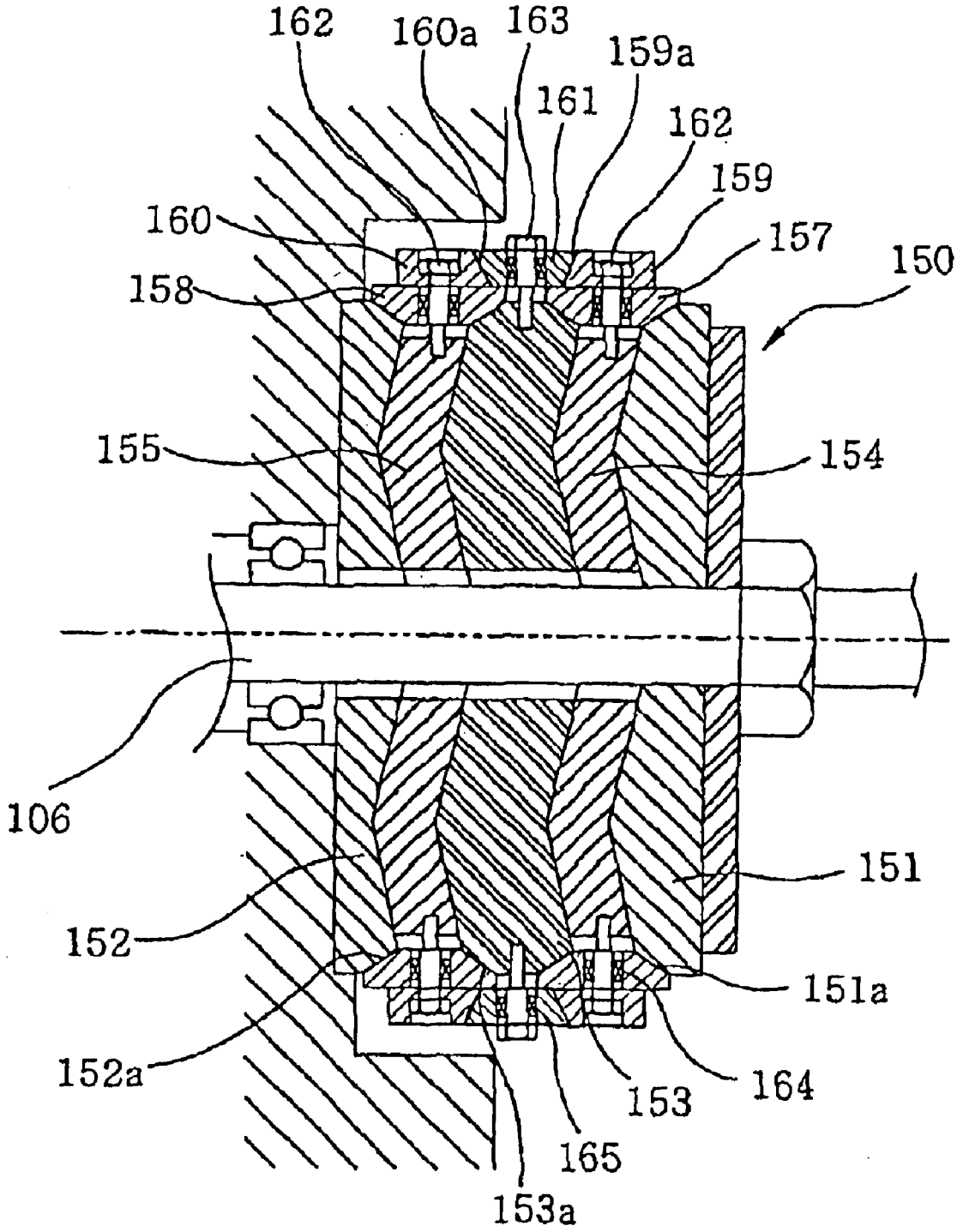
FIG. 6 shows an example of a modified thrust bearing assembly.

Referring to FIG. 6, there is illustrated a modified thrust bearing assembly 120. The modified thrust bearing assembly 120 includes a first, a second, a third, a fourth and a fifth circular plate 151 to 155, which are laminated on top of each other and are in a fractional contact with each other.

A bevel gear 151*a* is installed at one side of the first circular plate 151 and a bevel gear 152*a*, at one side of the second circular plate 152. A bevel gear 153*a* is installed at both sides of the third circular plate disposed between the first and the second circular plate 151, 152.

A plurality of first bevel pinion gears 157 mesh with the bevel gears 151*a*, 153*a* respectively formed at the first and the third circular plate 151, 153. A multiplicity of second bevel pinion gears 158 mesh with the bevel gear 153*a* and 152*a* respectively formed at the third and the second circular plate 153, 152.

A first and a second bevel ring gear 159, 160 are installed at the first and the second bevel pinion gear 157, 158 in a manner as to cover the first and the second bevel pinion gear 157, 158. Formed at one side of the first and the second bevel ring gear 159, 160 are a bevel gears 159*a*, 160*a*. A plurality of third bevel pinion gears 161 mesh with the bevel gears 159*a* and 160*a* respectively formed at the first and the second bevel ring gear 159, 160.

The first and the second bevel ring gear 159, 160, the first and the second bevel pinion gears 157, 158, and the fourth and the fifth circular plate 154, 155 are connected in one body by a plurality of first connecting parts 162. The each of first connecting parts 162 is inserted into a corresponding center portion of the first and the second bevel pinion gears 157, 158 along with a bearing 164 to support the first and the second bevel pinion gears 157, 158 rotatably.

The third bevel pinion gear 161 and the third circular plate 153 are connected in one body by a multiplicity of second connecting parts 163. The each of second connecting parts 163 is inserted into a corresponding center portion of the third bevel pinion gear 161 along with a bearing 165 to support the third bevel pinion gear 161 rotatably.

The wobble plate engine in accordance with the present invention is operated as follows. The oscillating member 110, which is supported at the declined shaft 107 of the drive shaft 105 by the ball bearing 108 and the thrust bearing assembly 120, oscillates as the drive shaft 105 rotates. Then, the four rods 112*a* to 112*d* connected to the oscillating member 110 make the four pistons 104 respectively installed in the four cylinders 103 within the cylinder block 102 reciprocate successively.

A pressure generated during a compression and an explosion process within the cylinders 103 is transferred to the declined shaft 107 through the rod 112*a* and the oscillating member 110, thereby generating a bending moment on the declined shaft 107. At this time, since the one end of the weight 109, installed at the end portion of the straight shaft 106 of the drive shaft 105, is supported by the thrust bearing assembly 120 prepared at the front portion of the cylinder block 102, the load applied to the declined shaft 107 may be dispersed to the cylinder block 102 through the weight 109 and the thrust bearing assembly 120. Accordingly, the load applied to the declined shaft 107 is reduced, and the durability of the drive shaft 105 is improved.

Further, vibrations caused due to the eccentricity of the drive shaft 105 while the drive shaft 105 rotates can be prevented by the weight 109, which is extended opposite to the declined shaft 107. Still further, since the bevel gear 114 located at a bottom portion of the oscillating member 110 meshes partially with the bevel gear 115 prepared at the front portion of the cylinder block 102, the rotation of the oscillating member 110 is prevented while the oscillating member 110 is oscillated by the revolution of the drive shaft 105.

The oscillation of the oscillating member 110 makes the four rods 112*a* to 112*d* respectively connected to the four arms 110*a* to 110*d* of the oscillating member 110 reciprocate successively, which in turn makes the four pistons 104, respectively coupled to the other ends of the four arms 110*a* to 110*d*, reciprocate successively in the cylinders 103, thereby operating the engine.

The oscillating motion of the oscillating member 110 will now be described in detail with reference to FIGS. 2 and 3. The oscillating member 110 oscillates with respect to an intersecting point (marked as G in FIG. 2) of central lines of the drive shaft 105 and the declined shaft 107, thereby successively moving the four rods 112*a* to 112*d* rectilinearly, which in turn makes the four pistons 104 reciprocate successively.

As shown in FIG. 2, the first arm 110*a* of the oscillating member 100 pushes the rod 112*a* to thereby make the piston 104 move forward. In the meantime, the third arm 110*c* of the oscillating member 110, which is located opposite to the first arm 110*a* of the oscillating member 110, pulls the rod 112*c* to thereby retrieve the piston 104.

Next, the first arm 110*a* of the oscillating member 110 withdraws, and the second arm 110*b* (shown in FIG. 3) of the oscillating member 110 pushes the rod 112*b* to make the piston 104 move forward. Meanwhile, the fourth arm 110*d* of the oscillating member 110, which is positioned opposite to the second arm 110*b* of the oscillating member 100, pulls the rod 112*d* to thereby retrieve the piston 104. Thereafter, the second arm 110*b* of the oscillating member 110 withdraws, and the third arm 110*c* (shown in FIG. 3) of the oscillating member 110 pushes the rod 112*c* to thereby move the piston 104 forward. In the meantime, the first arm 110*a* of the oscillating member 110, which is located opposite to the second arm 110*c* of the oscillating member 110 pulls the rod 112*a* to thereby retrieve the piston 104.

Then, the third arm 110*c* of the oscillating member 110 withdraws, and the fourth arm 110*d* of the oscillating member 110 pushes the rod 112*d* to move the piston 104 forward. Meanwhile, the second arm 110*b* of the oscillating member 110, which is disposed opposite to the fourth arm 110*d* of the oscillating member 110, pulls the rod 112*b* to thereby retrieve piston 104. This cycle is repeatedly performed, whereby the engine is operated.

The wobble plate engine in accordance with the present invention employs a single side support system where both end portions of the straight shaft 106 of the drive shaft 105 are supported in the cylinder block 102 through the ball bearing 108 and the thrust bearing assembly 120, respectively, while the declined shaft 107 of the drive shaft 105 is not in a fixed position. Accordingly, in contrast to the conventional wobble plate engine adopting a both side support system where both end portions of the drive shaft are supported at two different cylinder blocks, the wobble plate engine of the present invention can be effectively scaled down in size and weight and moreover, its simple structure helps an easy fabrication thereof.

Next, the operation of the thrust bearing assemblies 120 and 150, which are respectively installed at the cylinder block 102 and the oscillating member 110 to support the straight shaft 106, the declined shaft 107 and the weight 109, will now be described hereinafter.

As illustrated in FIGS. 4 and 6, the rotary force of the straight shaft 106 is transferred to the first circular plate 121 (151) of the thrust bearing assembly 120. The rotary force transferred to the first circular plate 121 (151) is then delivered to the third circular plate 123 (153) through the first bevel pinion gear 127 (157). The rotary force transferred to the first bevel pinion gear 127 (157) is delivered to the fourth circular plate 124 (154), the first bevel ring gear 129 (159), and the third bevel pinion gear 131 (161), wherein the fourth circular plate 124 (154) is coupled to the first bevel pinion gear 127 (157) through the first connecting parts 132 (162).

Then, the rotary force transferred to the third circular plate 123 (153) is delivered to the second circular plate 122 (152) through the second bevel pinion gear 128 (158). Thereafter, the rotary force delivered to the second bevel pinion gear 128 (158) is transferred to the second bevel ring gear 130 (160), the fifth circular plate 125 (155), and the third bevel pinion gear 131 (161), wherein the second bevel pinion gear 128 (158) is connected to the second bevel ring gear 130 (160) through the second connecting parts 132 (162). At this time, the second circular plate 122 (152) does not rotate because it is fixed at the cylinder block 102.

Thus, the first circular plate 121 (151), the first bevel ring gear 129 (159), the third circular plate 123 (153), and the second bevel ring gear 130 (160) of the thrust bearing assembly 120 (150) are revolved successively by the rotary force provided from the straight shaft 106. The rotation number of each element depends on its location, decreasing as the locations of the successive elements being distanced away from the first circular plate 121 (151) toward the second bevel ring gears 130 (160).

For example, the rotation velocity of each part of the thrust bearing assembly 120 (150) is set as Equation 1:

$$V_1 = \frac{V_0 + V_2}{2} \qquad \text{Equation 1}$$

$$V_2 = \frac{V_1 + V_3}{2}$$

$$V_3 = \frac{V_2 + V_4}{2}$$

$$V_4 = 0$$

wherein $V_0$, $V_1$, $V_2$, $V_3$, and $V_4$ respectively refer to the rotation velocity of the first circular plate, the first bevel ring gear, the third circular plate, the second bevel ring gear and the second circular plate.

Thus, the rotation velocity of each part of the thrust bearing assembly is obtained as follows:

$$V_1 = \frac{3}{4}V_0$$

$$V_2 = \frac{2}{4}V_0$$

$$V_3 = \frac{1}{4}V_0,$$

Accordingly, if the rotation velocity $V_0$ of the first circular plate 121 (151) is 6000 RPM, the rotation velocity $V_1$ of the first bevel ring gear 129 (159), the rotation velocity $V_2$ of the third circular plate 123 (153), and the rotation velocity $V_3$ of the second bevel ring gear 130 (160) are calculated to be 4500 RPM, 3000 RPM and 1500 RPM, respectively.

Therefore, the rotational velocities of the first circular plate 121 (151), the first bevel ring gear 129 (159), the third circular plate 123 (153), and the second bevel ring gear 130 (160) of the thrust bearing assembly 120 (150) become reduced gradually by about 1500 RPM, as the successive locations of the elements distanced away from the first circular plate 121 (151) to the second bevel ring gear 130 (160).

Further, in case the balls. 126 are placed between the circular plates as shown in FIG. 4, the rotation velocities of the balls 126 between the first and the fourth circular plates 121, 124, between the fourth and the third circular plates 124, 123, between the third and the fifth circular plates 123, 125, and between the fifth and the second circular plates 125, 122 are reduced to 1500 RPM.

Therefore, the thrust bearing assembly in accordance with the present invention can reduce the rotation velocity transferred from the drive shaft by way of the operations described above. Accordingly, the wobble plate engine can have an increased lifetime and, thus, its commercial value is improved.

As described above, the wobble plate engine in accordance with the present invention employs the single side support system where only one end portion of the drive shaft is supported in the cylinder block, which is different from the conventional wobble plate engine using the both sides support system where both end portions of the drive shaft are supported at two different cylinder blocks. Accordingly, the wobble plate engine of the present invention can be effectively scaled down in size and weight, and, further, can be easily fabricated.

Further, by employing the thrust bearing assembly capable of reducing the rotation velocity transferred from the drive shaft, the lifetime of the supporting part of the driving shaft can be increased, and, thus, the commercial value of the wobble plate engine is improved.

While the invention has been shown and described with respect to the preferred embodiments, it will be understood by those skilled in the art that various changes and modifications may be made without departing from the spirit and scope of the invention as defined in the following claims.

What is claimed is:

1. A wobble plate engine comprising:

a cylinder block in which a plurality of cylinders are circularly disposed;

a plurality of pistons, each being installed in one of the cylinder to reciprocate therein;

a drive shaft having a straight shaft and a declined shaft, the straight shaft being rotatably installed at a center portion of the cylinder block and the declined shaft being extended from an end portion of the straight shaft;

a weight formed at a joint portion of the straight shaft and the declined shaft in such a manner as to be extended opposite to the declined shaft;

an oscillating member supported at the declined shaft of the drive shaft;

a plurality of rods connecting the pistons to the oscillating member;

a pair of bevel gears facing each other and respectively formed at the oscillating member and the cylinder block to prevent the oscillating member from rotating; and a plurality of thrust bearing assemblies installed at the cylinder block and the oscillating member to support the straight shaft, the weight and the declined shaft and reduce a rotational velocity transferred therefrom.

2. The wobble plate engine of claim 1, wherein the thrust bearing assembly includes a first and a second circular plate having a bevel gear formed at one side thereof; a third circular plate installed between the first and the second circular plate and having bevel gears prepared at both sides thereof; a fourth and a fifth circular plate placed between the first and the third circular plate and between the third and the second circular plate, respectively; a plurality of balls in a multiplicity of rows disposed between the circular plates; a plurality of first bevel pinion gears meshing with the bevel gears formed at the first and the third circular plate and a plurality of second bevel pinion gears meshing with the bevel gears formed at the third and the second circular plate; a first and a second bevel ring gear installed to cover the first bevel pinion gears and the second bevel pinion gears, respectively, each of the first and the second bevel ring gears having a bevel gear installed at one side thereof facing the third circular plate; a plurality of third bevel pinion gears engaged with the first and the second bevel ring gears; a plurality of first connecting parts inserted into respective center portions of the first and the second bevel pinion gears along with a bearing to connect the first bevel ring gear, the first bevel ring gear and the fourth circular plate in one body and the second bevel ring gear, the second bevel pinion gear and the fifth circular plate in another one body; a plurality of second connecting parts installed into respective center portions of the third bevel pinion gears along with a bearing to connect the third bevel gears and the third circular plate as one body.

3. The wobble plate engine of claim 1, wherein the thrust bearing assembly includes a first and a second circular plate having a bevel gear formed at one side thereof; a third circular plate installed between the first and the second circular plate and having bevel gears prepared at both sides thereof; a fourth and a fifth circular plate placed between the first and the third circular plate and between the third and the second circular plate, respectively; a plurality of first bevel pinion gears meshing with the bevel gears formed at the first and the third circular plate and a plurality of second bevel pinion gears meshing with the bevel gears formed at the third and the second circular plate; a first and a second bevel ring gear installed to cover the first bevel pinion gear and the second bevel pinion gear, respectively, each of the first and the second bevel ring gears having a bevel gear installed at one side thereof facing the third circular plate; a plurality of third bevel pinion gears meshing with the first and the second bevel ring gears; a plurality of first connecting parts inserted into respective center portions of the first and the second bevel pinion ring gears along with a bearing to connect the first bevel ring gear, the first bevel pinion gear and the fourth circular late in one body and the second bevel ring gear, the second bevel pinion gear and the fifth circular plate in another body; a plurality of second connecting parts installed into respective center portions of the third bevel pinion gears along with a bearing to connect the third bevel gear and the third circular plate as one body.

4. The engine of claim 2, wherein protruding part and a groove are formed at a portion where the weight and the thrust bearing assembly are brought into contact with each other.

5. The engine of claim 3, wherein a protruding part and a groove are formed at a portion where the weight and the thrust bearing assembly are brought into contact with each other.

* * * * *